US007420145B2

(12) United States Patent
Kim

(10) Patent No.: US 7,420,145 B2
(45) Date of Patent: Sep. 2, 2008

(54) METHOD FOR PREVENTING OVERHEATING OF MICROWAVE OVEN

(75) Inventor: Seung Hoe Kim, Paju-si (KR)

(73) Assignee: Daewoo Electronics Corporation, Seoul (KR)

( * ) Notice: Subject to any disclaimer, the term of this patent is extended or adjusted under 35 U.S.C. 154(b) by 0 days.

(21) Appl. No.: 11/362,349

(22) Filed: Feb. 27, 2006

(65) Prior Publication Data

US 2006/0141116 A1 Jun. 29, 2006

(30) Foreign Application Priority Data

Dec. 20, 2005 (KR) ..... 10-2005-0126023

(51) Int. Cl.
*H05B 6/68* (2006.01)

(52) U.S. Cl. ..... 219/719; 219/702

(58) Field of Classification Search ..... 219/719, 219/702, 718, 715, 716, 717, 704, 710, 680, 219/685, 739, 756, 762, 763
See application file for complete search history.

(56) References Cited

U.S. PATENT DOCUMENTS 6,593,556 B1 * 7/2003 Kim ..... 219/702
7,132,633 B2 * 11/2006 Lee et al. ..... 219/680
2003/0218009 A1 * 11/2003 Lee ..... 219/721

FOREIGN PATENT DOCUMENTS

KR 10-2004-0002164 1/2004

* cited by examiner

*Primary Examiner*—Quang Van
(74) *Attorney, Agent, or Firm*—The Nath Law Group; Jerald L. Meyer

(57) ABSTRACT

A method for preventing overheating of a microwave oven including a controller for controlling an output level of a magnetron is disclosed. The method includes: a) receiving information of cooking conditions and a cooking start command input by a user, the cooking conditions including an output level of the magnetron for subsequent cooking, b) detecting a pausing period of time from a time of finishing preceding cooking to a time of starting the subsequent cooking if it is determined that the output level of the magnetron is greater than a preset output level thereof, and c) operating the microwave oven at the preset output level after changing the output level to the preset output level according to the detected pausing period. According to this method, components of the microwave oven are effectively prevented from being overheated while maintaining cooking efficiency.

14 Claims, 2 Drawing Sheets

METHOD FOR PREVENTING OVERHEATING OF MICROWAVE OVEN

BACKGROUND OF THE INVENTION

1. Field of the Invention

The present invention relates to a method for preventing overheating of a microwave oven.

2. Description of the Related Art

A microwave oven is a kitchen appliance based on a principle that generates heat via molecular motion of the food itself by passing microwave radiation at a frequency of about 2,450 MHz through the food within a metallic case.

In the microwave oven, when microwave radiation at the frequency of about 2,450 MHz is oscillated from a magnetron, and passes through the food in a cooking chamber, molecules constituting the food are charged to have a positive charge and a negative charge arranged at opposite sides thereof by the microwave radiation. At this time, the molecules have the positive charge at one side near a negative polarity of electric field created by the microwave beam, and the negative charge at the other side near a positive polarity of the electric field.

In this regard, polarity of electric field is changed two thousand four hundred and fifty million times per second, and causes severe collisions between the molecules, so that the food is cooked by heat created by the collision of the molecules of the food.

FIG. 1 is a constructional view illustrating a conventional microwave oven.

As shown in FIG. 1, the conventional microwave oven comprises a power terminal through which commercial alternating current power is supplied, a fan motor 50 connected with the power terminal to drive a cooling fan for cooling various electric components, a tray motor 60 connected in parallel with the fan motor 50 to rotate a tray of a cooling chamber, a high voltage transformer 70 connected with the power source to supply high voltage power to a magnetron.

In addition, a fuse 80 and a door switch 90 are connected in series between the power terminal and the fan motor 50 in which the door switch 90 is switched on and off according to opening and closing of a door of the microwave oven. A sub relay 30 is connected between the power terminal and the fan motor 50, and a main relay 40 is connected between the fan motor 50 and a primary coil of the high voltage transformer 70.

The microwave oven further comprises a controller 20 which outputs a control signal in order to control the main relay 40 and the sub relay 30 to be switched on/off according to a key signal input from a key input part 10. The sub relay 30 is switched on/off according to the control signal from the controller 20, and serves to supply or cut off the commercial AC power through the power terminal to or from the fan motor 50, the tray motor 60, and the high voltage transformer 70. The main relay 40 is switched on or off according to the control signal from the controller 20, and serves to supply or cut off the commercial AC power through the power terminal to or from the high voltage transformer 70.

In the conventional microwave oven, when the magnetron is continuously operated for a long period of time by supplying power to the high voltage transformer 70, various electric components of the microwave oven including the high voltage transformer 70 are liable to be overheated, and thus it is necessary to control an output level according to a cooking period of time.

However, the conventional microwave oven has a problem in that, since the output level is determined depending on the cooking period of time, the electric components can be damaged due to overheating of the microwave oven which can occur when an internal temperature of the microwave oven before or after cooking is not considered in the case where the microwave oven is continuously operated without a pause or with intervals of short pauses.

SUMMARY OF THE INVENTION

The present invention has been made to solve the above problems, and it is an object of the present invention to provide a method for preventing overheating of a microwave oven, by which an output of a magnetron can be automatically controlled according to an operating time and a pausing period of the microwave oven, thereby preventing the microwave oven from being overheated.

In accordance with one aspect of the present invention, the above and other objects can be accomplished by the provision of a method for preventing overheating of a microwave oven including a controller for controlling an output level of a magnetron, the method comprising the steps of: receiving information of cooking conditions and a cooking start command input by a user, the cooking conditions comprising an output level of the magnetron for subsequent cooking; detecting a pausing period of time from a time of finishing preceding cooking to a time of starting the subsequent cooking if it is determined that the output level of the magnetron is greater than a preset output level thereof; and operating the microwave oven at the preset output level after changing the output level to the preset output level according to the detected pausing period.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Figure 1:
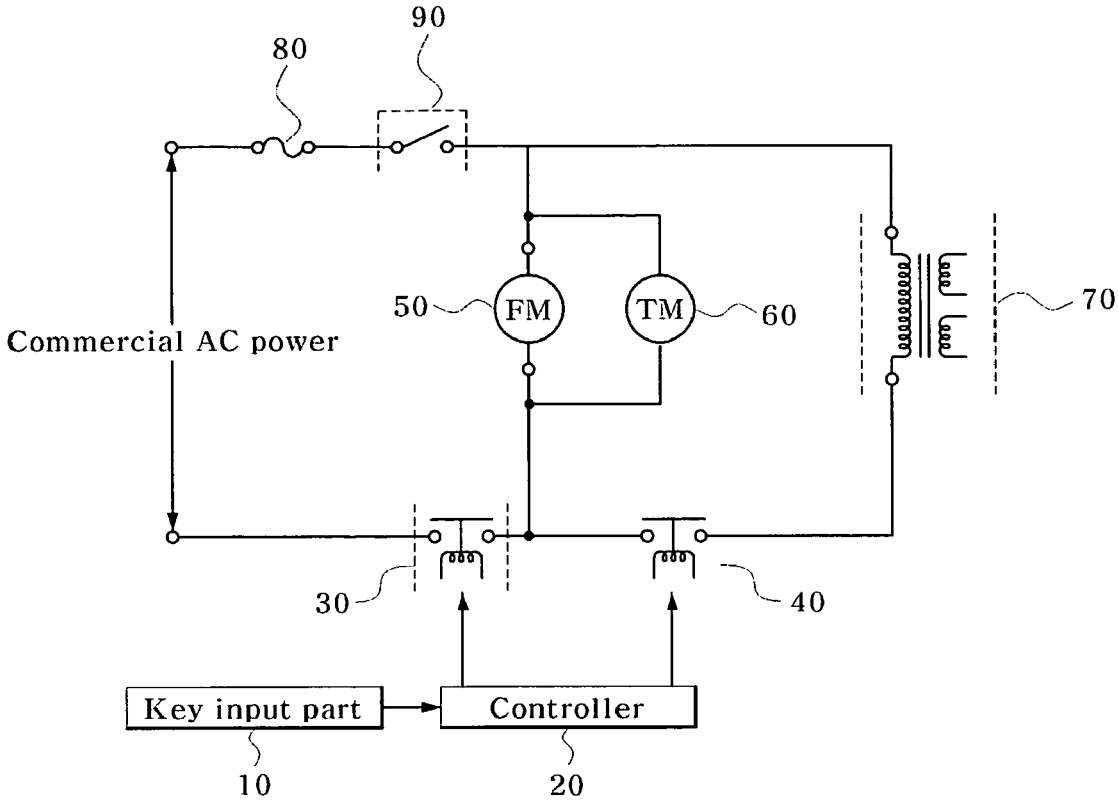
Fig. 1 (Prior Art)
FIG. 1 is a circuit diagram illustrating a conventional microwave oven.

Preferred embodiments of the present invention will be described in detail with reference to the accompanying drawings along with description of terms and reference characters.

T: a cooking period of time preset by a user.

td: a period of time during which a microwave oven is not operated before start of current cooking. That is, it means a pausing period of time between preceding cooking and current cooking.

Specifically, it further comprises an elapsed period from a time of stopping the microwave oven by opening a door of the microwave oven or by pushing buttons to temporarily pause, stop or cancel during operation of the microwave oven as well as a time of finishing of preceding cooking, i.e., an end of cooking period, to a time of pushing a button for starting current cooking.

T1: an operating period of time for preceding cooking. That is, it means an operating period of the microwave oven during which the microwave oven is operated for the preceding cooking.

Here, if the pausing period of time td is 5 minutes or less between previous cooking periods of time, T1 means a cooking period of time obtained by adding the previous cooking periods of time before and after the pausing period of time. For example, if the microwave oven is operated in the sequence of 10 minutes cooking+25 minutes or less pausing+current cooking, T1 required for changing an output level of a magnetron for the current cooking is 10 minutes which is the preceding cooking period of time. If the microwave oven is operated in the sequence of 10 minutes cooking+2 minutes pausing+10 minutes cooking+2 minutes pausing+current cooking, T1 required for changing the output level of the magnetron for the current cooking is 20 minutes which is obtained by adding 10 minutes and 10 minutes.

T2: a reference period of time for changing the output level. Specifically, it means a period of time for changing the output level during cooking, and is set to T2=T1+t2+a weighted value.

The weighted value is determined by T1 and td, and is provided as 0, 5, 10 and the like.

t2: an elapsed period of current cooking. That is, it means an elapsed period of subsequent cooking.

A: a basic level output value, which is provided as a value to operate the microwave oven at an output level preset by the user for a predetermined period of time prior to operation in any other conditions related to change of an output level when the microwave oven starts cooking.

That, when the microwave oven starts cooking, it operates at an output level predetermined by the user for A minutes so long as an output level changing event is not generated.

According to the present invention, A is provided as 0, 5, and 13 according to the range of td.

Z: a counter value for changing an output level. It means a value increasing by 1 when the pausing period of time "td" between preceding cooking and subsequent cooking is 25 minutes or less. If Z is 4 or more, that is, if the preceding cooking is continuously performed 4 or more times, followed by the subsequent cooking within 25 minutes or less, the microwave oven is forced to operate directly at an output level of 70% instead of an initial output level for A minutes according to the range of the pausing period of time even if the output level is set to 80% or more by a user.

Final operating condition: a condition wherein a pausing period of time "td" between preceding cooking and subsequent cooking exceeds 25 minutes. At this time, Z is converted to 1.

A method for preventing overheating of a microwave oven according to the invention will hereinafter be described with reference to FIG. 2.

Figure 2:
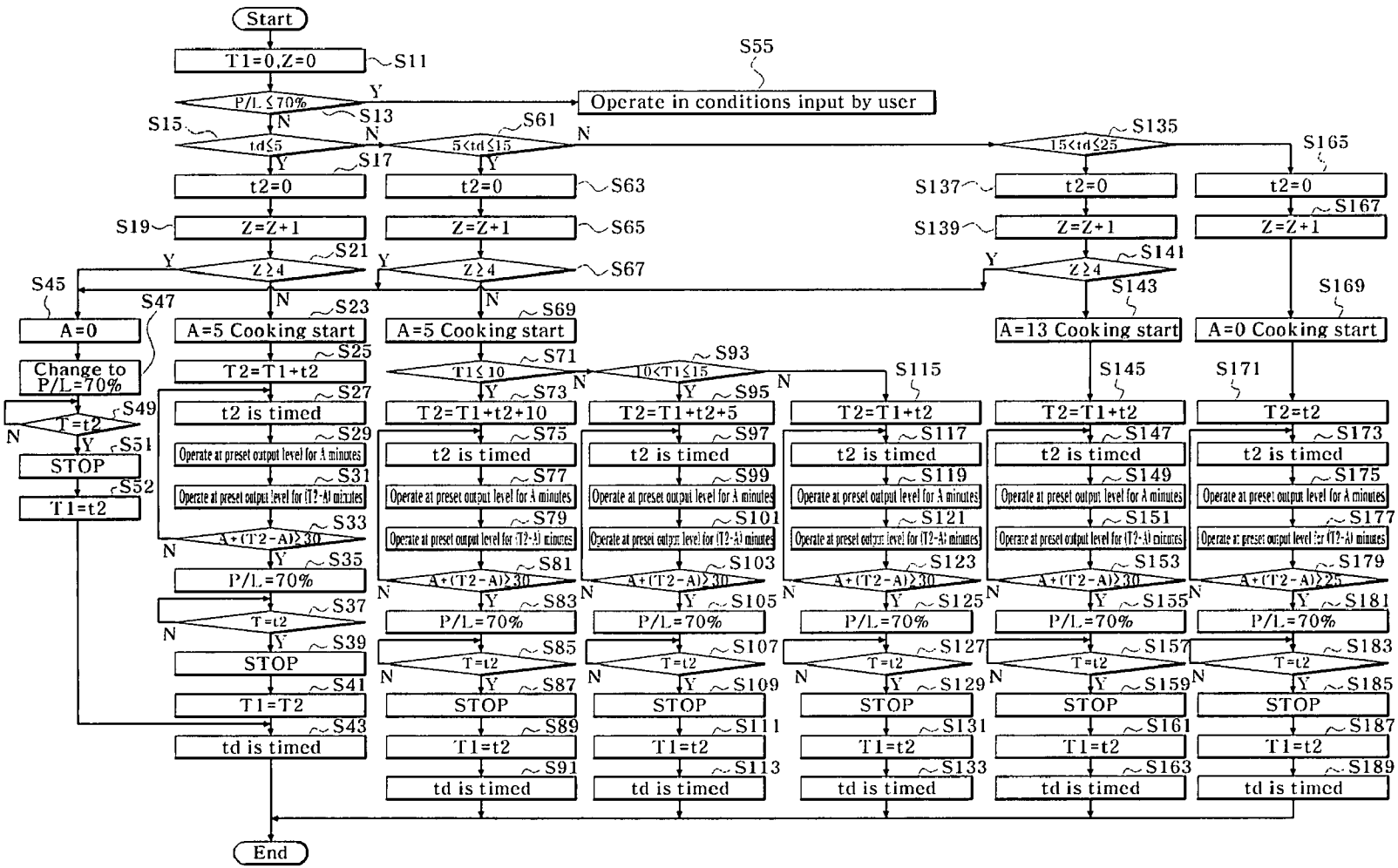
FIG. 2 is a flow diagram illustrating a method for preventing overheating of a microwave oven in accordance with one embodiment of the present invention.

As shown in FIG. 2, a process of preventing overheating of the microwave oven according to the invention is executed as soon as a user inputs a cooking start command to the microwave oven after setting a cooking period of time and an output level of a magnetron for cooking a predetermined food. First, at S11, T1 and Z are initialized, and then, at S13, it is determined whether or not a power level, i.e., an output level of the magnetron is 70% or less.

As a result of determination at step S13, if it is determined that the power level is 70% or less, the microwave oven operates according to the preset conditions input by the user. If it is determined that the power level is greater than 70%, the process moves to S15, wherein it is determined whether or not td is 5 or less.

If it is determined at step S15 that td is greater than 5, the process moves to S61 to determine whether or not td is in the range of 5<td≦15 (S61). If it is determined at S15 that td is 5 or less, the process moves to S17 wherein t2 is initialized to 0, and then at S19, Z is set to Z+1.

Then, at S21, it is determined whether or not Z is 4 or more. If it is determined that Z is 4 or more, the process moves to S45 wherein A is set to 0. If it is determined that Z is less than 4, the process moves to S23 wherein the microwave oven starts cooking after setting A to 5.

At S25, T1 is set to t2+t2, and at S27, t2 is timed. Then, at S29, the microwave oven is operated at a preset output level for A minutes.

At S31, the microwave oven is operated at the preset output level for (T2−A) minutes, and at S33, it is determined whether or not A+(T2−A), that is, T2, is 30 minutes or more.

As a result of determination at S27, if it is determined that T2 is less than 30 minutes, the process returns to S27. If it is determined that T2 is 30 minutes or more, the process moves to S35 wherein the power level is converted to 70%. Then, at S37, it is determined whether or not T is t2.

As a result of determination at S37, if it is determined that T is not t2, step S37 is repeated until T becomes t2. If it is determined that T is t2, the process moves to S39 wherein operation of the microwave oven is stopped.

Then, at S41, T1 is set to T2, and at S43, timing of td is started, and continued until operation command is input by the user.

That is, if td is 5 minutes or less, T1 at subsequent cooking is obtained by T2(T1+t2) which is achieved by adding the period of time for preceding cooking and current cooking, instead of t2 which is the elapsed period for current cooking.

Meanwhile, after step S45, the process moves to S47 wherein the power level is converted to 70%. Then, at S49, it is determined whether or not T is t2.

If it is determined that T is not t2, step S49 is repeated until T becomes t2. If it is determined that T is t2, the process moves to S51 wherein operation of the microwave oven is stopped.

Then, at S53, T1 is set to t2, and the process moves to S43.

Meanwhile, as a result of determination at S61, if it is determined that td is not in the range of 5<td≦15, the process moves to S63 wherein t2 is initialized to 0, and at S65, Z is set to Z+1.

Then, at S67, it is determined whether or not Z is 4 or more. If it is determined that Z is 4 or more, the process moves to S45 wherein A is set to 0. If it is determined that Z is less than 4, the process moves to S69 wherein the microwave oven starts cooking after setting A to 5.

Then, at S71, it is determined whether or not T1 is 10 or less. If it is determined that T1 is more than 10, the process moves to S93 wherein it is determined whether T1 is in the range of 10<T1 ≦15. If it is determined that T1 is 10 or less, the process moves to S73 wherein T1 is set to t2+t2+10. Then, at S75, t2 is timed, and at S77, the microwave oven is operated at the preset output level for A minutes.

At S79, the microwave oven is operated at the preset output level for (T2−A) minutes, and at S81, it is determined whether or not A+(T2−A), that is, T2, is 30 minutes or more.

As a result of determination at S81, if it is determined that T2 is less than 30 minutes, the process returns to S75. If it is determined that T2 is 30 minutes or more, the process moves to S83 wherein the power level is converted to 70%. Then, at S85, it is determined whether or not T is t2.

As a result of determination at S85, if it is determined that T is not t2, step S37 is repeated until T becomes t2, and if it is determined that T is t2, the process moves to S87 wherein operation of the microwave oven is stopped.

Then, at S89, T1 is set to t2, and at S91, timing of td is started, and continued until operation command is input by the user.

Meanwhile, as a result of determination at S93, if it is determined that T1 is not in the range of 10<td≦15, that is, if it is determined that T1 is greater than 15, the process moves to S115 wherein T1 is set to t2+t2. On the contrary, if it is determined that T1 is in the range of 10<td≦15, the process moves to S95 wherein T1 is set to t2+t2+5, and at S97, t2 is timed. Then, at S99, the microwave oven is operated at the preset output level for A minutes.

At the next step S101, the microwave oven is operated at the preset output level for (T2−A) minutes, and at S103, it is determined whether or not A+(T2−A), that is, T2, is 30 minutes or more.

As a result of determination at S103, if it is determined that T2 is less than 30 minutes, the process returns to S97. If it is determined that T2 is 30 minutes or more, the process moves to S105 wherein the power level is converted to 70%. Then, at S107, it is determined whether or not T is t2.

As a result of determination at S107, if it is determined that T is not t2, step S107 is repeated until T becomes t2, and if it is determined that T is t2, the process moves to S109 wherein operation of the microwave oven is stopped.

Then, at S111, T1 is set to t2, and at S113, timing of td is started, and continued until operation command is input by the user.

Then, after step S115, t2 is timed at S117, and at S119, the microwave oven is operated at the preset output level for A minutes.

At S121, the microwave oven is operated at the preset output level for (T2−A) minutes, and at S123, it is determined whether or not A+(T2−A), that is, T2, is 30 minutes or more.

As a result of determination at S123, if it is determined that T2 is less than 30 minutes, the process returns to S117. If it is determined that T2 is 30 minutes or more, the process moves to S125 wherein the power level is converted to 70%. Then, at S127, it is determined whether or not T is t2.

As a result of determination at S127, if it is determined that T is not t2, step S127 is repeated until T becomes t2. If it is determined that T is t2, the process moves to S129 wherein operation of the microwave oven is stopped.

Then, at S131, T1 is set to t2, and at S133, timing of td is started, and continued until operation command is input by the user.

Meanwhile, as a result of determination at S135, if it is determined that td is not in the range of 15<td≦25, the process moves to S165 wherein t2 is initialized to 0. If it is determined that td is in the range of 15<td≦25, the process moves to S137 wherein t2 is initialized to 0, and at S139, Z is set to Z+1.

Then, at S141, it is determined whether or not Z is 4 or more. If it is determined that Z is 4 or more, the process moves to S45 wherein A is set to 0. If it is determined that Z is less than 4, the process moves to S143 wherein the microwave oven starts cooking after setting A to 13.

Then, at S145, T2 is set to T1+t2, and at S147, t2 is timed. Next, at S149, the microwave oven is operated at the preset output level for A minutes.

At S151, the microwave oven is operated at the preset output level for (T2−A) minutes, and at S81, it is determined whether or not A+(T2−A), that is, T2, is 30 minutes or more.

As a result of determination at S135, if it is determined that T2 is less than 30 minutes, the process returns to S147. If it is determined that T2 is 30 minutes or more, the process moves to S155 wherein the power level is converted to 70%. Then, at S157, it is determined whether or not T is t2.

As a result of determination at S157, if it is determined that T is not t2, step S157 is repeated until T becomes t2. If it is determined that T is t2, the process moves to S159 wherein operation of the microwave oven is stopped.

Then, at S161, T1 is set to t2, and at S163, timing of td is started, and continued until operation command is input by the user (S165).

Meanwhile, after 1 is added to Z at S167 and A is set to 0 at S196, the microwave oven starts cooking.

Then, at S171, T1 is set to t2, and at S173, timing of td is started, and continued until operation command is input by the user at S175.

At S171, T2 is set to t2, and at S173, t2 is timed. At S175, the microwave oven is operated at the preset output level for A minutes.

At S177, the microwave oven is operated at the preset output level for (T2−A) minutes, and at S179, it is determined whether or not A+(T2−A), that is, T2, is 25 minutes or more.

As a result of determination at S179, if it is determined that T2 is less than 25 minutes, the process returns to S173. If it is determined that T2 is 25 minutes or more, the process moves to S181 wherein the power level is converted to 70%. Then, at S183, it is determined whether or not T is t2.

As a result of determination at S183, if it is determined that T is not t2, step S183 is repeated until T becomes t2. If it is determined that T is t2, the process moves to S185 wherein operation of the microwave oven is stopped.

Then, at S187, T1 is set to t2, and at S189, timing of td is started, and continued until operation command is input by the user.

Accordingly, if the microwave oven is continuously operated with a pausing period of time within 5 minutes or less, it is possible to prevent overheating of the microwave oven by adding a preceding cooking period of time to a current cooking period of time. If a pausing period of time is in the range of 5 to 15 minutes, T1 is divided into an operating period of 10 minutes or less, an operating period in the range of 10 minutes<T1<15 minutes and an operating period of 15 minutes or more, and a weight value of +10, +5 or +0 is added to T1, thereby solving the problem upon continuous cooking of 3 times or more.

In particular, the reason of setting A to 13 minutes at step S143, and of setting A to 0 at step S169 is that these pausing periods are considered to be sufficient to cool the components of the microwave oven, and prevent damage of the microwave oven. In addition, the reason of determining at step S179 whether T2 is 25 minutes or more is that A is O which is different from the other conditions.

Meanwhile, it is desirable that the value of Z be set to 0 when the microcomputer is reset at an initial operation, that Z be increased by 1 when the microwave oven is continuously used, and that Z be set to 1 when td is 25 minutes or more.

As apparent from the above description, with the method for preventing overheating of the microwave oven according to the invention, if a user controls the microwave oven to operate at a magnetron output level of 70% or less, it is operated according to conditions input by the user, but if the user controls the microwave oven to operate at an output level above 70%, the output level of the magnetron is automatically changed according to a preceding cooking period and a pausing period, so that the components of the microwave oven are effectively prevented from being overheated while maintaining cooking efficiency even when a short period of time is required for cooking.

It should be understood that the embodiments and the accompanying drawings have been described for illustrative purposes and the present invention is limited by the following claims. Further, those skilled in the art will appreciate that various modifications, additions and substitutions are allowed without departing from the scope and spirit of the invention as set forth in the accompanying claims.

What is claimed is:

1. A method for preventing overheating of a microwave oven including a controller for controlling an output level of a magnetron, the method comprising the steps of:

a) receiving information of cooking conditions and a cooking start command input by a user, the cooking conditions comprising an output level of the magnetron for subsequent cooking;

b) detecting a pausing period of time from a time of finishing preceding cooking to a time of starting the subsequent cooking if it is determined that the output level of the magnetron is greater than a preset output level thereof; and c) operating the microwave oven at the preset output level after changing the output level of the magnetron to the preset output level according to the detected pausing period.

2. The method according to claim 1, wherein the cooking conditions further comprises a cooking period of time, and at the step c), the output level of the magnetron is adjusted to the preset output level according to the pausing period of time and a reference period of time for changing the output level, the reference period of time for changing the output level being obtained by adding an operating period of time for the preceding cooking and an elapsed period of the subsequent cooking.

3. The method according to claim 2, further comprising: outputting the output level of the magnetron corresponding to the cooking conditions during a preset basic level output period of time before the step c).

4. The method according to claim 3, wherein the basic level output period of time is set differently according to the pausing period of time.

5. The method according to claim 4, wherein the operating period of time for the preceding cooking is obtained by adding an operating period of time for immediately preceding cooking with respect to the subsequent cooking and operating periods of time for other preceding cooking prior to the immediately preceding cooking according to the pausing period of time.

6. The method according to claim 3, wherein the operating period of time for the preceding cooking is obtained by adding an operating period of time for immediately preceding cooking with respect to the subsequent cooking and operating periods of time for other preceding cooking prior to the immediately preceding cooking according to the pausing period of time.

7. The method according to claim 6, wherein the reference period of time is obtained by adding a preset period of time thereto according to the pausing period of time.

8. A method for preventing overheating of a microwave oven including a controller for controlling an output level of a magnetron, the method comprising the steps of:

a) receiving information of cooking conditions and a cooking start command input by a user, the cooking conditions comprising an output level of the magnetron for subsequent cooking;

b) detecting a pausing period of time from a time of finishing preceding cooking to a time of starting the subsequent cooking if it is determined that the output level of the magnetron is greater than a preset output level thereof;

c) increasing a counter value for changing the output level if the pausing period of time is a preset pausing period of time or less, and initializing the counter value for changing the output level if the pausing period of time exceeds the preset pausing period of time; and d) operating the microwave oven at the preset output level after changing the output level of the magnetron to the preset output level if the counter value for changing the output level is a preset value or more, and operating the microwave oven at the preset output level after changing the output level to of the magnetron the preset output level according to the detected pausing period of time if the counter value for changing the output level is less than the preset value.

9. The method according to claim 8, wherein the cooking conditions further comprises a cooking period of time, and at the step d), the output level of the magnetron is adjusted to the preset output level according to the pausing period of time and a reference period of time for changing the output level if the counter value is less than the preset value, the reference period of time for changing the output level being obtained by adding an operating period of time for the preceding cooking and an elapsed period of the subsequent cooking.

10. The method according to claim 9, further comprising: outputting the output level of the magnetron corresponding to the cooking conditions during a preset basic level output period of time before the step d).

11. The method according to claim 10, wherein the basic level output period of time is set differently according to the pausing period of time.

12. The method according to claim 11, wherein the operating period of time for the preceding cooking is obtained by adding an operating period of time for immediately preceding cooking with respect to the subsequent cooking, and operating periods of time for other preceding cooking prior to the immediately preceding cooking according to the pausing period of time.

13. The method according to claim 10, wherein the operating period of time for the preceding cooking is obtained by adding an operating period of time for immediately preceding cooking with respect to the subsequent cooking, and operating periods of time for other preceding cooking prior to the immediately preceding cooking according to the pausing period of time.

14. The method according to claim 13, wherein the reference period of time for changing the output level is obtained by adding a preset period of time thereto according to the pausing period of time.

* * * * *